United States Patent [19]

Wiget

[11] 4,367,959

[45] Jan. 11, 1983

[54] PSEUDO-ANALOG DISPLAY DEVICE

[75] Inventor: Fridolin Wiget, Neuchatel, Switzerland

[73] Assignee: Ebauches, S.A., Switzerland

[21] Appl. No.: 184,316

[22] Filed: Sep. 5, 1980

[30] Foreign Application Priority Data

Sep. 7, 1979 [CH] Switzerland ..... 8071/79

[51] Int. Cl.³ ..... G04C 17/02; G09F 9/00

[52] U.S. Cl. ..... 368/240; 340/756

[58] Field of Search ..... 368/82–84, 368/239–242; 340/722, 755, 756

[56] References Cited

U.S. PATENT DOCUMENTS

| | | | |
|---|---|---|---|
| 3,750,384 | 8/1973 | Miller et al. | 368/82 |
| 3,823,549 | 7/1974 | Feldman | 368/82 |
| 4,106,281 | 8/1978 | Freeman | 368/240 |
| 4,121,415 | 10/1978 | Crutcher et al. | 368/240 X |

FOREIGN PATENT DOCUMENTS

| | | |
|---|---|---|
| 2381360 | 9/1978 | France . |
| 1027976 | 5/1966 | United Kingdom . |

*Primary Examiner*—Vit W. Miska

*Attorney, Agent, or Firm*—Allegretti, Newitt, Witcoff & McAndrews

[57] ABSTRACT

A circuit for producing a numerical signal representative of the value of the physical parameter which is to be displayed and which can assume a given number of values. The signal is applied to a decoder for controlling the display cell.

The decoder is so arranged as to render visible a single display element for certain values of the numerical signal and two adjacent elements for other values. The cell therefore comprises a small number of display elements than there are different values to be displayed.

1 Claim, 5 Drawing Figures

PSEUDO-ANALOG DISPLAY DEVICE

BACKGROUND OF THE INVENTION

The present invention concerns a devices for the pseudo-analog display of the value of a physical parameter.

Conventional analog devices which are intended to display the value of a physical parameter generally comprise a hand or pointer which is mounted on a pivot. The hand or pointer is driven in rotation by a suitable mechanism and occupies an angular position corresponding to the value to be displayed, which can be read, opposite the hand or pointer, on a fixed graduated scale. In a first approximation, any variation in the value of the physical parameter, however small it may be, causes a corresponding variation in the position of the hand or pointer.

On the other hand, in pseudo-analog display devices the hand or pointer, or the member which takes the place thereof, can occupy only a given number of different positions. The value of the physical parameter measured must therefore vary at least by a given quantity in order for the displayed value to be changed. If necessary, the number of different positions on the display may be relatively high and minimum detectable variation can be relatively small so that the movements of the hand or pointer in dependence on the variations in the physical parameter are apparently continuous.

This type of display device which is well known generally comprises a circuit for producing a numerical signal whose value is representative of the value of the physical parameter. When the physical parameter is for example a pressure, a speed, etc., the circuit comprises a detector which produces an electrical signal representative of the value of the physical parameter, and an analog-to-digital converter. The latter produces the numerical signal representative of the value of the physical parameter, for example in binary form.

When the physical parameter is time, the numerical signal can be produced by a counting chain connected to a time base circuit.

In all cases, the numerical signal is applied to a code converter circuit which controls a pseudo-analog display cell, possibly by way of an amplifier circuit.

Such a display cell comprises display elements which are disposed one beside the other and the total number of which is equal to the number of values that may be assumed by the numerical signal.

The code converter and the display cell are so arranged that, for each of the values of the numerical signal, one and only one of the display elements is activated, that is to say, made visible.

The display elements are generally of such a shape that they resemble the pointer of a conventional display and a fixed scale is disposed in relation therewith so that the user of the device can read the corresponding value of the physical parameter, opposite the activated element.

The display cell may use light-emitting diodes (LED), a liquid crystal, an electrochromic material, or any other means.

When the physical parameter to be measured is a voltage, current, speed, pressure, etc., the display elements are generally disposed in a line, which may be straight or curved, like the graduations of a conventional analog display.

When the physical parameter to be measured is time, the display elements are generally disposed in a ring so that the last element is adjacent to the first element, like the arrangement of the graduations on the dial of a watch.

U.S. Pat. No. 3,987,617 in particular proposes a pseudo-analog display cell of the latter type, comprising twenty four display elements for displaying hours (in half-hours), sixty elements for displaying minutes, and as many for seconds. A display device using this kind of cell however suffers from poor legibility due to the small surface area of the display elements, in particular those used for displaying minutes. In addition, the production cost of a device of this type increases as the cell requires a greater number of external connections for connection to its control circuit.

BRIEF SUMMARY OF THE INVENTION

The object of the present invention is to benefit from the advantages of the known constructions and substantially to reduce the disadvantages therein by providing a pseudo-analog display device which enjoys good legibility and wherein the display cell comprises a reduced number of elements and therefore external connections.

In a preferred embodiment of the invention, this object is achieved by the provision of means for producing a numerical signal representative of the physical parameter, the numerical signal assuming a given number of different numerical values, display elements less in number than said numerical values and disposed so that each element is adjacent to at least one other element, and means responsive to the numerical signal for relatively activating a single display element when the numerical signal is one value and for selectively activating two adjacent elements when the numerical signal is another of said values.

BRIEF DESCRIPTION OF THE DRAWINGS

The invention will be described in more detail, by way of example, with reference to the accompanying drawings, in which.

DETAILED DESCRIPTION OF THE PREFERRED EMBODIMENT

Figure 1:
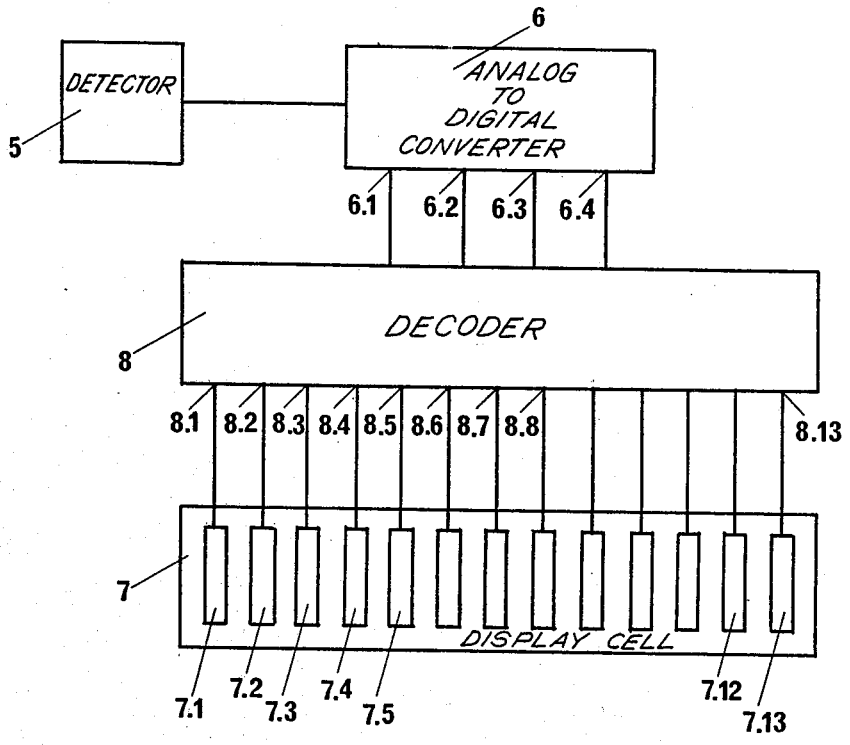
FIG. 1 is a diagrammatic view of an illustrative embodiment of the invention.

The device shown in FIG. 1 by way of example has deliberately been selected to be of a very simple design. It is intended for displaying the value of a physical parameter which varies between a minimum value 0 and a maximum value of 15 units. It will be appreciated that these units are the units for measuring the physical parameter in question. The degree of resolution required for the display is one unit.

The devices comprises a detector 5 which produces an electrical signal representing the physical parameter whose value is to be displayed. At the present time, there are detectors which are suitable for measuring virtually all measurable physical parameters such as pressure, temperature, speed of a moving body or a fluid, etc. These detectors are well known and will therefore not be described in greater detail herein.

Depending on the circumstances, the electrical signal that such detectors produce is a voltage or a current of which the amplitude, frequency or another characteristic is directly representative of the value of the physical parameter, in accordance with a given law which may be linear, logarithmic or otherwise.

The electrical signal produced by the detector 5 is applied, possibly after matching (not shown), to an analog-to-digital converter 6 which is also well known.

The converter 6 is provided with four outputs 6.1 to 6.4 which can each assume the logic state "0" or the logic state "1". Each of the sixteen combinations of these logic states corresponds to a given value of the signal produced by the detector 5 and therefore a given value of the physical parameter. These combinations are arranged in accordance with the normal sequence of numbers expressed in binary code, that is to say, the combination "0000" corresponds to the value 0 of the physical parameter, the combination "0001" corresponds to the value 1, etc., up to the combination "1111" which corresponds to the value 15 of the physical parameter.

The device further comprises a display cell 7 which may be of any type whatever, comprising light-emitting diodes, liquid crystals, electrochromic, etc.

The cell 7 comprises only thirteen display elements 7.1 to 7.13 which can be selectively activated, that is to say made visible, with respect to the rest of the cell.

A decoder 8 is connected between the converter 6 and the cell 7 and produces the control signals intended to activate the display elements, in a manner which will be described hereinafter. It will be appreciated that auxiliary signals may have to be supplied by the decoder to the cell 7. Such auxiliary signals need not be described herein as the circuits for producing such signals depend on the type of cell used, and the development thereof can readily be accomplished by the man skilled in the art.

When it is visible, each element is in the form of a point, a small circuit, a bar or any other suitable shape. The different elements are juxtaposed along a line which is straight in the present example but which could be curved.

The cell also comprises a fixed graduated scale (not shown) which is disposed adjacent to the display elements. The scale makes it possible to read the value of the physical parameter corresponding to the energized display element.

The decoder 8 is so arranged as to provide at its outputs 8.1 to 8.13 the signals for controlling the cell 7, in the manner shown diagrammatically in table I below. In table I, the sixteen lines each correspond to one of the values of the numerical signal supplied by the converter 6, these values being set forth in the first four columns. The thirteen other columns show the state of the outputs of the decoder 8, for each of the above-mentioned values. In the columns, a sign − indicates that the corresponding output is in the rest condition and therefore the display element which is connected thereto is not activated; a sign + indicates that the corresponding output provides a control signal and that the display element which is connected to that output is therefore activated.

TABLE I

| 6.1 | 6.2 | 6.3 | 6.4 | 8.1 | 8.2 | 8.3 | 8.4 | 8.5 | 8.6 | 8.7 | 8.8 | 8.9 | 8.10 | 8.11 | 8.12 | 8.13 |
|---|---|---|---|---|---|---|---|---|---|---|---|---|---|---|---|---|
| 0 | 0 | 0 | 0 | − | − | − | − | − | − | − | − | − | − | − | − | − |
| 0 | 0 | 0 | 1 | + | − | − | − | − | − | − | − | − | − | − | − | − |
| 0 | 0 | 1 | 0 | − | + | − | − | − | − | − | − | − | − | − | − | − |
| 0 | 0 | 1 | 1 | − | − | + | − | − | − | − | − | − | − | − | − | − |
| 0 | 1 | 0 | 0 | − | − | − | + | − | − | − | − | − | − | − | − | − |
| 0 | 1 | 0 | 1 | − | − | − | + | + | − | − | − | − | − | − | − | − |
| 0 | 1 | 1 | 0 | − | − | − | − | + | − | − | − | − | − | − | − | − |
| 0 | 1 | 1 | 1 | − | − | − | − | − | + | − | − | − | − | − | − | − |
| 1 | 0 | 0 | 0 | − | − | − | − | − | − | + | − | − | − | − | − | − |
| 1 | 0 | 0 | 1 | − | − | − | − | − | − | − | + | − | − | − | − | − |
| 1 | 0 | 1 | 0 | − | − | − | − | − | − | − | + | + | − | − | − | − |
| 1 | 0 | 1 | 1 | − | − | − | − | − | − | − | − | + | − | − | − | − |
| 1 | 1 | 0 | 0 | − | − | − | − | − | − | − | − | − | + | − | − | − |
| 1 | 1 | 0 | 1 | − | − | − | − | − | − | − | − | − | − | + | − | − |
| 1 | 1 | 1 | 0 | − | − | − | − | − | − | − | − | − | − | − | + | − |
| 1 | 1 | 1 | 1 | − | − | − | − | − | − | − | − | − | − | − | + | + |

The decoder 8 will not be described in greater detail herein as the design thereof can be of any well known type and is within the capability of the man skilled in the art.

Table I shows that no display element is activated for the value "0000" of the numerical signal. This state corresponds to the display of the value zero of the physical parameter. For each of the four following values "0001" to "0100" of the numerical signal, only one of the first four elements 7.1 to 7.4 is activated, as in a conventional display device. For the value "0101" of the numerical signal, which corresponds to the value 5 of the physical parameter, the fourth element 7.4 is again activated, at the same time as the fifth element 7.5.

The fifth element 7.5 is again activated for the following value "0110", but this time it is alone. The following elements 7.6 to 7.8 are then activated each for one of the following values "0111" to "1001". Two elements 7.8 and 7.9 are again activated simultaneously to display the following value "1010" of the numerical signal. The four following values "1011" to "1110" are each displayed by activation of a single one of the elements 7.9 to 7.12 respectively. Finally, the last value "1111" of the numerical signal is displayed by simultaneously activation of two elements 7.12 and 7.13.

The above-described display device therefore makes it possible to display the fifteen values, different from zero, of the physical parameter, by using only thirteen display elements 7.4, 7.5, 7.8, 7.9 and 7.12 in this example, are used, either alone or with the adjacent element, to display two separate values.

In the foregoing example, the elements 7.4, 7.5, 7.8, 7.9 and 7.12 are the last or the first of three groups of four elements. These three groups permit the display of fourteen values of the physical parameter. The element 7.13 is added to these groups to permit the fifteenth value to be displayed. It may be noted in passing that, if necessary, the thirteenth element would make it possible to display a possible sixteenth value.

It is apparent that, in other cases, the display elements could be more numerous and/or could be grouped in different ways without thereby departing from the scope of the invention. If for example one hundred different values of the physical parameter are to be displayed, the display device may comprise a cell having ninety one elements which are arranged in ten groups of nine elements plus a complementary element. The values displayed by simultaneous activation of the last element of one group and the first element of the following group would then be the tenth, twentieth, etc. If, in such a case, the elements are grouped in fours, as in the previous example, eighty one elements or twenty groups of four elements, plus again a complementary element, are sufficient for displaying the one hundred values of the physical parameter.

The two examples, given above show that, for displaying N different values, wherein $N=m\cdot n$, it is possible by means of the invention to use only m groups of $(n-1)$ elements plus a complementary element.

In other words, the display cell only has to comprise $m\cdot(n-1)+1$ elements to display $m\cdot n$ different values.

It is possible to generalize to the case where $N=m\cdot n+a$ wherein a is the remainder from the division of N by m or n. It will be easily seen that the display cell must then comprise $m\cdot(n-1)+b$ elements, wherein $b=1$ if $a=0$ and $b=a$ if $a\neq 0$.

It is understood that the decoder 8 must be adapted to each particular situation.

Besides the reduction in the number of display elements required, the above-described device has the advantage of displaying in a clearly visible and special manner, particular values of the physical parameter. In the first example described above, these are the values 5, 10 and 15 which are each displayed by the activation of two adjacent elements.

The device according to the invention is used to particular advantage when the physical parameter, the values of which are to be displayed, is time. In this particular case, the device according to the invention forms an electronic timepiece. The numerical signal is then provided by a counting chain connected to a time base circuit which generally comprises a quartz oscillator.

Figure 2A:
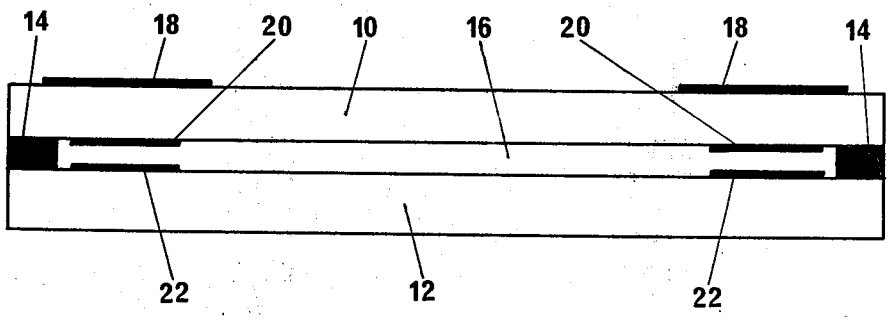
FIG. 2*a* is a sectional view of part of a display cell which can be used in a second embodiment.
Figure 2B:
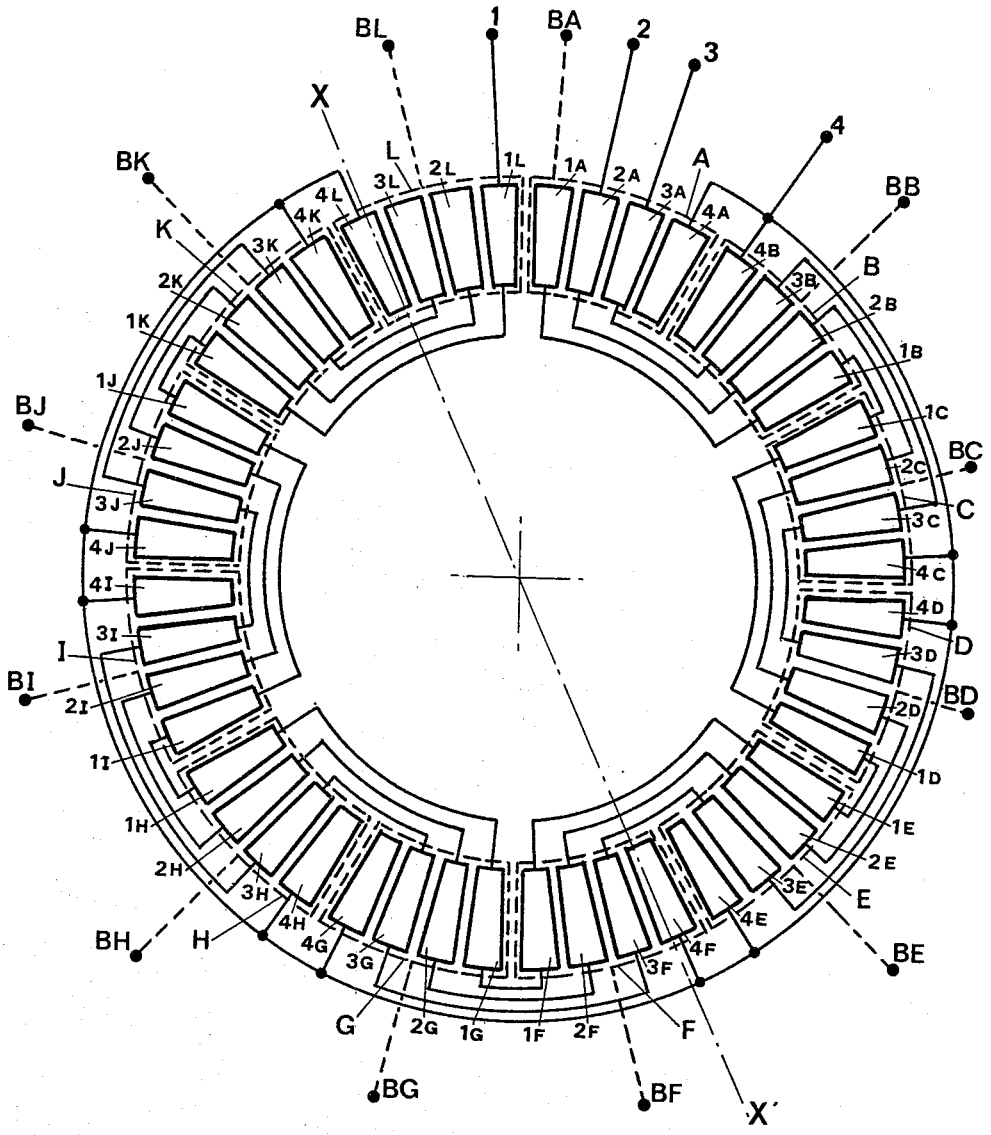
FIG. 2*b* is a plan view of part of the cell of FIG. 2*a*.
Figure 3:
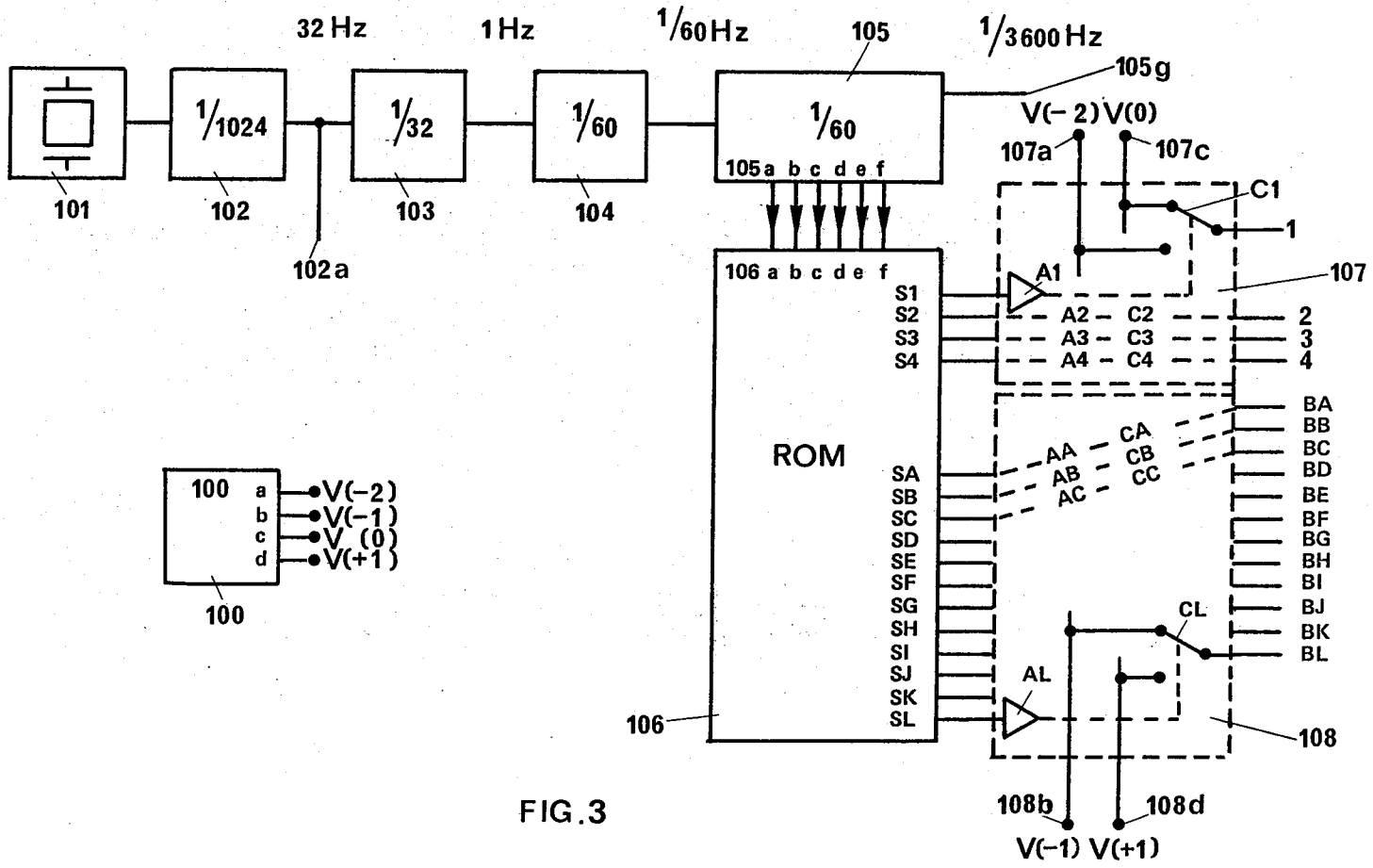
FIG. 3 is a block diagram of one example of a circuit for activating the elements of the cell shown in FIG. 2.
Figure 4:
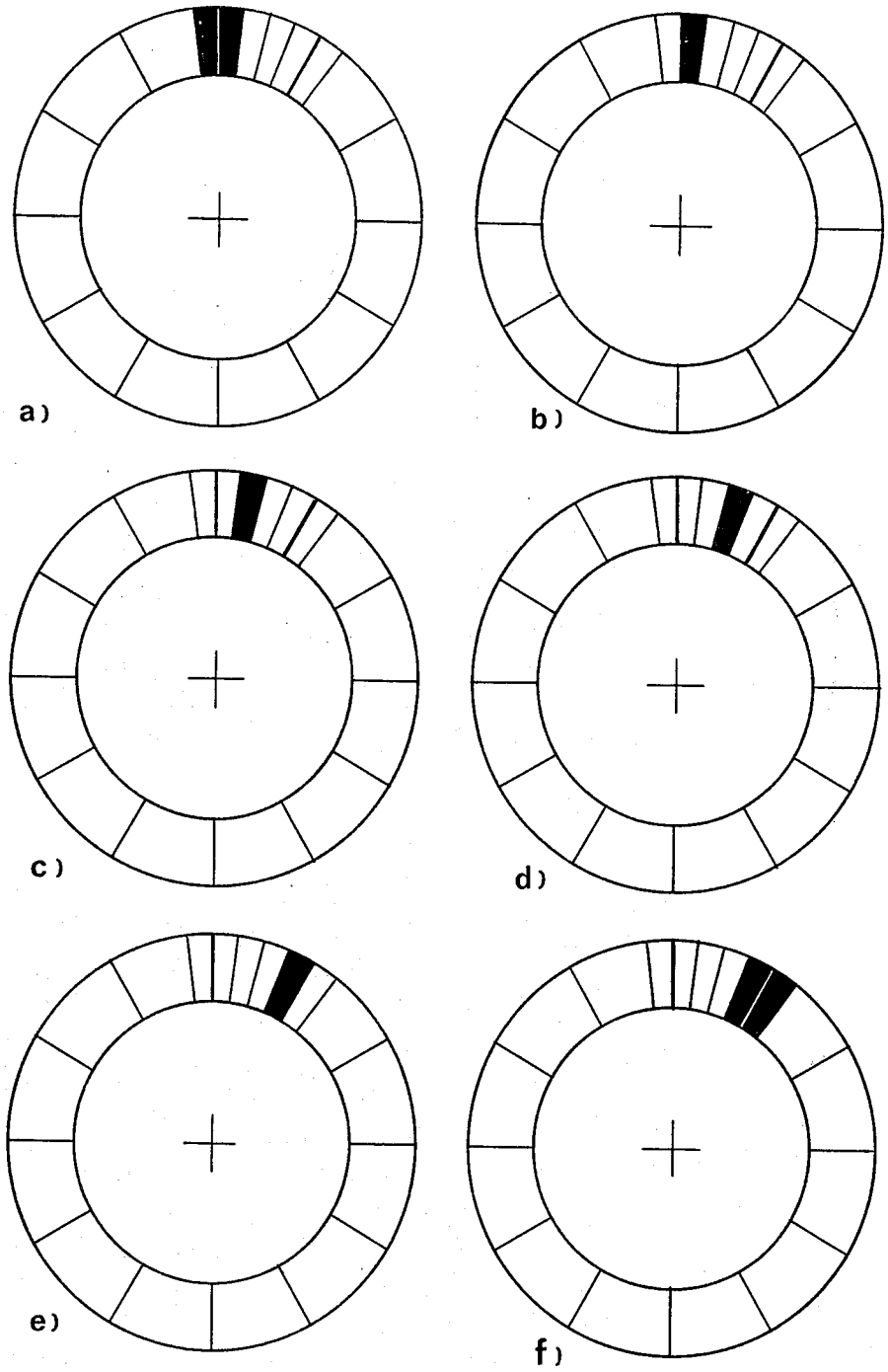
FIG. 4 shows the display of six successive values by the cell shown in FIG. 2.

FIGS. 2 to 4 show such an embodiment of the device according to the invention wherein the numerical signal corresponds, by way of example, to the number of minutes in real time.

FIG. 2 shows a display cell which can be used in this illustrative embodiment of the invention.

As shown in FIG. 2*a*, this cell comprises a front support plate 10 and a rear support plate 12 which are both transparent and which are of circular shape and which are held parallel to each other by an annular element 14 to which they are hermetically sealed. The volume between the two plates is filled with a display medium 16. Fixed marks 18 are provided on the outside face of the front plate 10. A system of electrodes 20 is disposed on the inside face of the front plate 10, while a system of counter-electrodes 22 is disposed on the inside face of the rear plate 12. In this example, the display medium 16 is a liquid crystal of nematic type.

There are many ways of using the changes in the optical properties of such a liquid crystal under the influence of an electrical field, in a display cell. These processes are well known and therefore need not be described in detail herein. In the present example, it will be assumed that the cell becomes dark in the regions in which the liquid crystal is subjected to an electrical field which is generated between at least one of the electrodes and at least one of the counter-electrodes, and that the liquid crystal is light in colour outside such regions.

FIG. 2*b* shows in solid lines the system of electrodes 20 of the front plate 10 and in broken lines the system of counter-electrodes 22 on the rear plate 12. The system of electrodes 22 on the rear plate 10 comprises forty eight electrodes which are in the shape of small rods or bars and which are regularly distributed in twelve groups of four electrodes 1A to 4A, 1B to 4B . . . and 1L to 4L. This system forms a ring and, in this example, the outside radius of the space containing the display medium 16, while the width of the ring is substantially between a quarter and a third of said radius. The fixed marks 18 which are not shown in this Figure for the sake of simplicity are disposed between the last electrode of a group and the first electrode of the following groups. There are therefore twelve such marks which are disposed like the marks for the hours on the face of a conventional watch.

The rear plate 12 comprises twelve counter-electrodes A, B, C . . . L forming a ring, each being disposed facing one of the groups of electrodes 1A to 4A, 1B to 4B, . . . 1L to 4L.

The four electrodes of the groups disposed opposite the counter-electrodes A, C, E, G, I and K bear reference numerals which increase in the clockwise direction, while those of the other groups bear numbers which increase in the anti-clockwise direction. The electrodes 4A and 4B are therefore adjacent, and the same applies in regard to the pairs of electrodes 1B–1C, 4C–4D, 1D–1E, 4E–4F . . . 4K–4L and 1L–1A.

The electrodes 1A to 4A, 1B to 4B, . . . 1L to 4L deposited on the front plate 10 comprise a conducting layer which is sufficiently thin to be transparent. The twelve counter-electrodes A, B, C . . . L which are deposited on the rear plate 12 are also formed by a conducting layer which may be transparent or reflecting, according to circumstances.

The twelve electrodes 1A, 1B, . . . 1L are connected together and to an input terminal 1. Likewise, the electrodes 2A, 2B . . . 2L, 3A, 3B . . . 3L and 4A, 4B . . . 4L are respectively connected together and to input terminals 2, 3 and 4.

The counter-electrode A is connected to an input terminal BA. Likewise, the eleven other counter-electrodes B . . . L are respectively connected to output terminals BB, BC . . . BL.

This display cell therefore comprises forty eight display elements which each comprise one of the regions which can be made visible by the application of a sufficient voltage between an electrode and a counter-electrode. These elements are therefore of the same shape as the electrodes and they will be denoted hereinafter in this description by the same reference numerals as the electrode to which they correspond.

By virtue of this ring-type arrangement, the last element of the last group is adjacent to the first element of the first group.

FIG. 3 is a block circuit diagram showing the decoder circuit associated with the above-described cell and the circuit for producing the numerical signal representing the number of minutes to be displayed.

The signal for producing the numerical signal comprises an oscillator 101 which in this embodiment produces pulses at a frequency of 32,769 Hz.

Three frequency dividers 102, 103 and 104 are connected in a cascade configuration at the output of the oscillator 101. These dividers have respective division ratios of 1024, 32 and 60 and thus supply signals at frequencies of 32 Hz, 1 Hz and 1/60 Hz, or 1 per minute.

This last signal is applied to the input of a six-stage counter 105 with a counting capacity of 60. The outputs 105*a* to 105*f* of the counter stages therefore represent altogether the numerical signal which in binary form corresponds to the number of minutes counted by the counter 105. The counter 105 is also provided with an output 105*g* which supplies one pulse per hour to an hours counter (not shown).

The decoder circuit comprises a read memory 106 (ROM) of which the six address inputs 106*a* to 106*f* are connected to the outputs 105*a* to 105*f* of the counter 105. For each of the sixty combinations of logic states ("000000" to "111011") that may be assumed by said six outputs 105*a* to 105*f*, the sixteen outputs of the memory 106, which are designated by SA to SL and S1 to S4 have a particular combination of logic states. In other words, the memory 106 contains sixty different words, each of sixteen bits, which can be selectively addressed by the counter 105. This memory is programmed to reply to the truth table of Table II below:

TABLE II

| Minute | Input ROM 106 a b c d e f | Output ROM S LKJIHGFEDCBA | Output ROM S 4 3 2 1 |
|---|---|---|---|
| 0 | 0 0 0 0 0 0 | 100000000001 | 0 0 0 1 |
| 1 | 0 0 0 0 0 1 | 000000000001 | 0 0 0 1 |
| 2 | 0 0 0 0 1 0 | 000000000001 | 0 0 1 0 |
| 3 | 0 0 0 0 1 1 | 000000000001 | 0 1 0 0 |
| 4 | 0 0 0 1 0 0 | 000000000001 | 1 0 0 0 |
| 5 | 0 0 0 1 0 1 | 000000000011 | 1 0 0 0 |
| 6 | 0 0 0 1 1 0 | 000000000010 | 1 0 0 0 |
| 7 | 0 0 0 1 1 1 | 000000000010 | 0 1 0 0 |
| 8 | 0 0 1 0 0 0 | 000000000010 | 0 0 1 0 |
| 9 | 0 0 1 0 0 1 | 000000000010 | 0 0 0 1 |
| 10 | 0 0 1 0 1 0 | 000000000110 | 0 0 0 1 |
| 11 | 0 0 1 0 1 1 | 000000000100 | 0 0 0 1 |
| 12 | 0 0 1 1 0 0 | 000000000100 | 0 0 1 0 |
| • | | | |
| • | | | |
| 59 | 1 1 1 0 1 1 | 100000000000 | 0 0 0 1 |

The decoder circuit further comprises a circuit for controlling the electrodes and the counter-electrodes in FIG. 2.

It is well known that, in order to make a region of a liquid crystal type display visible, a voltage greater than a given threshold voltage must be applied between the electrode and the counter-electrode coresponding to that region. A known design which is useful in the present example comprises selectively applying to the electrodes and to the counter-electrodes of the cell, potentials which are selected from four potentials, designated by V(−2), V(−1), V(0) and V(+1), which are such that only the difference between the potentials V(−2) and V(+1) is greater than the threshold voltage. The above-specifed designations mean that V(+1) and V(−1) are of the same absolute value but have a different sign with respect to the potential V(0) and that the potential V(−2) is double the potentional V(−1).

Each of the four potentials is provided by one of the four outputs 100*a*, 100*b*, 100*c* and 100*d* of a voltage source 100.

The control circuit formed by the two switching circuits 107 and 108 is arranged so as to apply the desired potentials to the terminals 1 to 4 and BA to BL of the cell. The circuit 107 is connected to the terminals 100*a* and 100*c* of the voltage source 100 by its inputs 107*a* and 107*c* which are therefore respectively at the potential levels V(−2) and V(0). The circuit 107 comprises amplifiers A1, A2, A3 and A4 whose inputs are connected to the outputs S1 to S4 of the memory 106, and switching means C1, C2, C3 and C4. The switching means C1 which is controlled by A1 connects the input 107*a* to the output 1 of the circuit 107 when S1 is at logic level "1" and connects the input 107*c* to the output 1 when S1 is at logic level "0".

The switching means C2 which is controlled by A2 connects the inputs 107*a* and 107*c* to the output of the circuit 107 according to whether S2 is at level "1" or level "0". The same also applies in regard to C3, A3 and C4, A4 which in the same way cause correspondence between the level of the terminals 3 and 4 of the circuit 107 and the logic states of the outputs S3 and S4.

The circuit 108 is arranged in a similar manner and is connected to the terminals 100*b* and 100*d* of the voltage source 100 by its inputs 108*b* and 108*d* which are therefore respectively at potentials V(−1) and V(+1). It comprises amplifiers AA, AB, . . . AL which control switching means CA, CB, . . . CL and it permits the terminals BA, BB, . . . BL to be set to the potential level V(+1) or V(−1) when the outputs of the memory 106 SA, SB, . . . SL are respectively at the level "1" or "0".

To simplify FIG. 2, only the amplifiers A1 and AL and the switching means C1 and CL are shown, with the latter being shown as switching means comprising fixed contacts and a movable contact which are separate from the amplifiers. In practice, the amplifiers and the switching means, and all the others which are not shown, would be combined and formed by known electronic circuits comprising for example complementary MOS transistors.

As has already been indicated above, a region of the display becomes visible whenever the electrode and the corresponding counter electrode are respectively at potential V(−2) and V(+1). When, for example, the first minute of an hour is to be displayed, the outputs S1 and SA of the memory 106 are at state "1" and all its other outputs are at state "0". The switching means CL and CA are therefore actuated and the electrodes 1A to 1L are set at potential V(−2) while the counter-electrode BA is at potential V(+1). The other electrodes are all at potential V(0) and the other counter-electrodes are all at potential V(−1). The result of this is that only the display element corresponding to the electrode 1A is activated as it is the only one in which the electrode and the counter-electrode have been respectively set at potentials V(−2) and V(+1), the different between which is greater than the threshold voltage of the liquid crystal. The counter-electrodes of the other elements 1B to 1L, in respect of which the electrode is also set at potential V(−2), are at potential V(−1). The electrodes of the elements 2A to 4A which have the same counter-electrode as the element 1A are at potential V(0). All the other elements 2A to 4A which have the same counter-electrode as the element 1A are at potential V(0). All the other elements 2B to 4B, 2C to 4C, etc. up to 2L to 4L have their electrode at potential V(0) and their counter-electrode at potential V(+1). None of these elements is therefore activated.

Table II and FIG. 4 show how the first six minutes of the hour are displayed in this way.

TABLE III

| Minute | Counter-electrodes at potential V(+1) | Electrodes at potential V(−2) | Illustrated in FIG. |
|---|---|---|---|
| 0 | L,A | 1 | 3a |
| 1 | A | 1 | 3b |
| 2 | A | 2 | 3c |
| 3 | A | 3 | 3d |
| 4 | A | 4 | 3e |
| 5 | A,B | 4 | 3f |
| • | | | |
| • | | | |

In summary, to display the sixty normal values of the number of minutes in real time, the display cell comprises forty eight elements which are arranged in twelve groups of four elements. The 5th, 10th . . . 55th and 60th minutes of the hour are displayed by the simultaneous energization of the last element of a group and the first element of the following group, which are disposed on respective sides of the fixed marks 18, that is to say, respectively, elements 4A and 4B, 1B and 1C, 4C and 4D . . . and 1L and 1A. The first, sixth, eleventh . . . fifty sixth minutes are displayed by activation of the first elements 1A, 4B, 1C . . . and 4L of each group respectively. The following elements 2A, 3A, 4A, 3B, 2B, 1B . . . 3L, 2L and 1L respectively provide for the display of the second, third, fourth, seventh, eighth, ninth . . . fifty seventh, fifty eighth and fifty ninth minutes respectively.

Thus, each element adjacent to one of the fixed marks 18 is used for the display of two consecutive minutes. For example, the element 4A provides for the display of the fourth minute and, with element 4B, for display of the fifth minute. The element 4B alone also serves to display the sixth minute.

Thus, the sixty minutes of an hour are displayed by activation of forty eight elements only. The period of an hour is divided into sub-periods of five minutes, that is to say, five units of time, which are displayed by the successive activation of four display elements. The fifth, tenth . . . fifty fifth and sixtieth minutes, that is to say, the last unit of time of the first, second . . . eleventh and twelfth sub-period are displayed by activating the last element of a group and the first element of the following group.

It is clear that the device in this second embodiment can be used for the display of units of time other than a minute: a second for example with a period of one minute and a sub-period of five seconds. For that purpose, it is only necessary to use a circuit similar to that shown in FIG. 3, wherein the inputs of the memory 106 would be connected to the outputs (not shown) of the divider 104.

It is understood that the hour may be displayed in a similar manner, the unit of time displayed being 1/5 hour, the period being 12 hours and the sub-period being 1 hour.

It is also understood that the second embodiment of the device is not limited to displaying real time and that it can be perfectly well adapted for example to displaying a chronometer time.

Generally, in this second embodiment, a display cell comprising m groups of (n−1) elements makes it possible to display the m·n units of a period of time. This period is divided into m sub-periods in which the n units are displayed by the successive activation of the (n−1) elements of a group and by the simultaneous activation of the last element of a group and the first element of the following group.

Timing apparatuses with a pseudo-analog display can be produced by providing in the same cell, concentric rings of elements for displaying hours, minutes and possibly seconds.

It is also possible for hours to be displayed by activating a single element of a ring of twelve elements. Activation of these elements is then controlled by a counter (not shown) connected to the output **105*g* of the counter 105**. A simple watch with an easily legible display with a minimum number of display elements and therefore connections between the cell and the electronic circuit can be made in this way.

It is also possible to produce a time piece displaying one or more units of time, for example hours and minutes, in the pseudo-analog manner described, while displaying other data such as seconds, the date or the name of the month by means of numerical and/or alphabetic characters.

Finally, the device in this second embodiment is not limited to displaying time. It can also be used for displaying any other physical parameters, the values of which vary cyclicly.

It may be advantageous, in a display device comprising liquid crystals, for the potentials of the electrodes and the counter-electrodes to be reversed at a certain frequency, for example 32 Hz. In this case, a control signal may be taken from the output **102*a* of the divider 102 and aplied to the voltage source 100 which is then so arranged as to reverse the potentials produced by its outputs 100*a* and 100*d* on the one hand and 100*b* and 100*c*** on the other hand, in response to that signal.

Finally, the principle of the device described may be applied to devices wherein the display cell uses physical phenomena other than liquid crystal cells. Such cells may be for example electrochromic cells, cells with light-emitting diodes, etc.

Various other modifications may be made in the form of the invention without departing from the principles disclosed in the foregoing illustrative embodiments. It is intended therefore that the accompanying claims be construed as broadly as possible consistent with the prior art.

What is claimed is:

1. In an electronic time piece, the improvement of a display device including a first ring of only forty-eight electrodes arranged in twelve groups of four electrodes each, the first, the second, the third, and the fourth electrode in each group being respectively connected to the fourth, the third, the second and the first electrode in both the adjacent groups, a second ring of twelve counter-electrodes disposed each in a facing relationship with one of said groups of four electrodes, and a display medium disposed between said first and said second ring.

* * * * *